US006443109B1

(12) United States Patent
Achor et al.

(10) Patent No.: US 6,443,109 B1
(45) Date of Patent: Sep. 3, 2002

(54) TWO-STROKE OIL INJECTION SYSTEM

(75) Inventors: Kyle D. Achor, Flora; John E. Troxler, Logansport, both of IN (US)

(73) Assignee: Federal-Mogul World-Wide, Inc.

( * ) Notice: Subject to any disclaimer, the term of this patent is extended or adjusted under 35 U.S.C. 154(b) by 0 days.

(21) Appl. No.: 09/875,688

(22) Filed: Jun. 6, 2001

(51) Int. Cl.[7] ..... F02M 39/00
(52) U.S. Cl. ..... 123/73 AD; 123/196 R
(58) Field of Search ..... 123/73 AD, 196 R

(56) References Cited

U.S. PATENT DOCUMENTS

| | | | | |
|---|---|---|---|---|
| 4,142,486 A | | 3/1979 | Schreier | |
| 4,887,559 A | | 12/1989 | Hensel et al. | |
| 4,966,105 A | * | 10/1990 | Mori | 123/73 AD |
| 5,020,484 A | * | 6/1991 | Ishikawa et al. | 123/73 AD |
| 5,630,383 A | | 5/1997 | Kidera et al. | |
| 5,762,040 A | | 6/1998 | Taipale et al. | |
| 5,762,047 A | | 6/1998 | Yoshioka et al. | |
| 5,842,455 A | | 12/1998 | Tuckey et al. | |
| 5,941,745 A | | 8/1999 | Kanno | |
| 5,967,120 A | | 10/1999 | Blanton et al. | |

* cited by examiner

*Primary Examiner*—Marguerite McMahon
(74) *Attorney, Agent, or Firm*—Baker & Daniels

(57) ABSTRACT

An oil injection system for two-stroke engines, including a pressure regulator located within an oil reservoir, the pressure regulator selectively returning a portion of pumped oil directly back to the oil reservoir to prevent oil from exiting the reservoir at a higher than desired pressure. The pressure regulator allows a portion of the pumped oil from the oil reservoir to flow through the oil line to a solenoid valve, where the pressure regulator and solenoid valve together meter the flow of oil to a plurality of oil injectors for injection into the engine cylinders. Locating the pressure regulator within the oil reservoir eliminates the need for a return line from the solenoid valve to the oil reservoir, thus simplifying the solenoid design as well as the overall design of the oil injection system.

20 Claims, 5 Drawing Sheets

TWO-STROKE OIL INJECTION SYSTEM

BACKGROUND OF THE INVENTION

1. Field of the Invention

The present invention relates to oil injection systems for two-stroke engines. More particularly, the present invention relates to an oil injection system having a pressure regulator for establishing an upper pressure limit in the oil line.

2. Description of the Related Art

Two-stroke engines require a fuel/oil mixture for operation, with the fuel component being ignited to drive one or more pistons, while the oil component lubricates the moving parts in the engine crankcase. Typically, the fuel and oil are pre-mixed externally of the engine, and the fuel/oil mixture is supplied to the engine cylinders from an external tank in which the fuel/oil mixture is stored. Recently, however, high-performance two-stroke engines have been developed which utilize injection systems in which the fuel and oil are each separately injected into the engine cylinders.

In one known oil injection system, oil is pumped by a diaphragm pump from an oil reservoir to a single oil injector, which injects the oil to a plurality of oil outlets for introduction into respective engine cylinders. The pump supplies oil in a great excess to that which is needed for introduction into the engine cylinders, necessitating a return line to communicate excess pumped oil from the single oil injector back to the oil reservoir, such that, in effect, the majority of the oil is continuously recirculated throughout the oil injection system. A disadvantage with this arrangement is that the single oil injector does not provide adequate metering of the pumped oil into each of the plurality of oil outlets, resulting in ineffective engine lubrication. A further disadvantage of this arrangement is the increased opportunity for leaks provided by the return line.

What is needed in the art is an oil injection system which provides adequate metering of oil to the engine, is simplified in overall design, includes simplified components, and is relatively simple and cost effective to manufacture.

SUMMARY OF THE INVENTION

The present invention provides an oil injection system for two-stroke engines, in which a pressure regulator located within an oil reservoir maintains pressure in a portion of the oil line and selectively returns oil from the oil line to the oil reservoir to prevent oil from exiting the reservoir at a higher than desired pressure. Because the pressure regulator is positioned within the oil reservoir, there is no need for a return line and the associated fittings.

Oil is pumped from the oil reservoir and is communicated to a valve, such as a solenoid valve, and is thereafter selectively conveyed to a plurality of oil injectors. The pressure regulator and the valve work together to meter the flow of oil to a plurality of oil injectors for injection into the engine cylinders. As a result of the superior oil metering capability provided by the pressure regulator and the solenoid valve of the current invention, an appropriately metered flow of pressurized oil is supplied to the oil injectors. Elimination of the oil return line, along with the location of the pressure regulator within the oil reservoir, reduces the risk of oil leaks occurring externally of the oil reservoir.

Positioning the pressure regulator within the oil reservoir advantageously simplifies the overall design of the oil injection system by eliminating a return line connecting the solenoid to the oil reservoir, as well as the fittings on the solenoid valve and on the oil reservoir which would be associated with the oil return line. The elimination of an oil return line additionally simplifies the structure of the solenoid valve by obviating the need for an outlet on the solenoid to allow flow to reach the oil return line.

In one form thereof, an oil injection system for a two-stroke engine is provided, including an oil reservoir containing a volume of oil therein; an oil pump disposed in the oil reservoir and operable to pump a measure of oil from the volume of oil through an oil line to the engine, the oil pump having a housing; and a pressure regulator disposed within the oil reservoir external of the pump housing and in fluid communication with the oil line, the pressure regulator selectively returning a portion of pumped oil to the volume of oil in the oil reservoir to prevent oil from exiting the reservoir at a pressure above a predefined pressure limit.

In another form thereof, an oil injection system for a two-stroke engine is provided, including an oil reservoir containing a volume of oil therein, the oil reservoir including an oil pump disposed within the oil reservoir and pumping oil from the volume of oil, and a pressure regulator disposed within the oil reservoir, the pressure regulator selectively returning a portion of pumped oil to the volume of oil in the oil reservoir to prevent oil from exiting the reservoir at a pressure above a predefined pressure limit, and a valve disposed externally of the oil reservoir and in fluid communication with the oil reservoir, the valve selectively operable between a first position in which the flow of pumped oil through the valve is blocked and a second position in which the flow of pumped oil through the valve is allowed.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION

Figure 3:
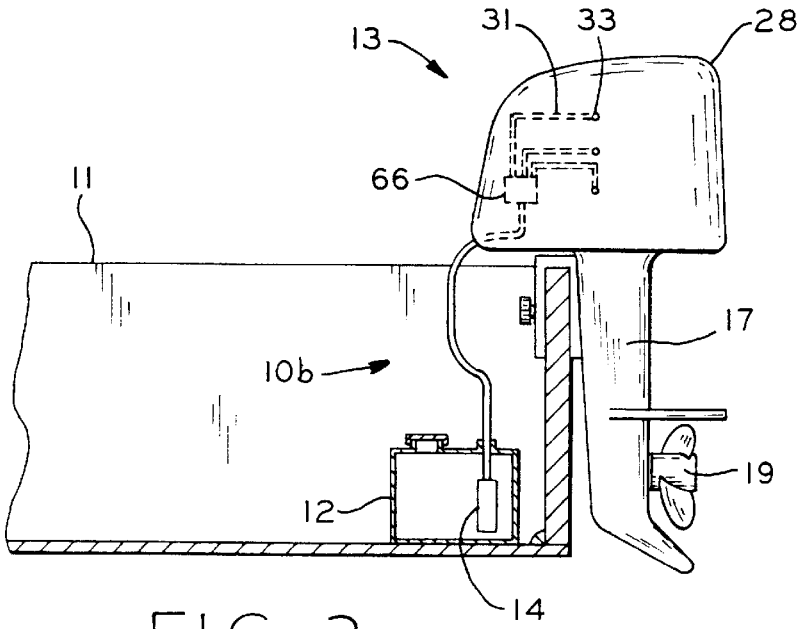
FIG. 3 is a schematic sectional view of a boat with an outboard engine, including the oil injection system of FIG. 2.
Figure 4:
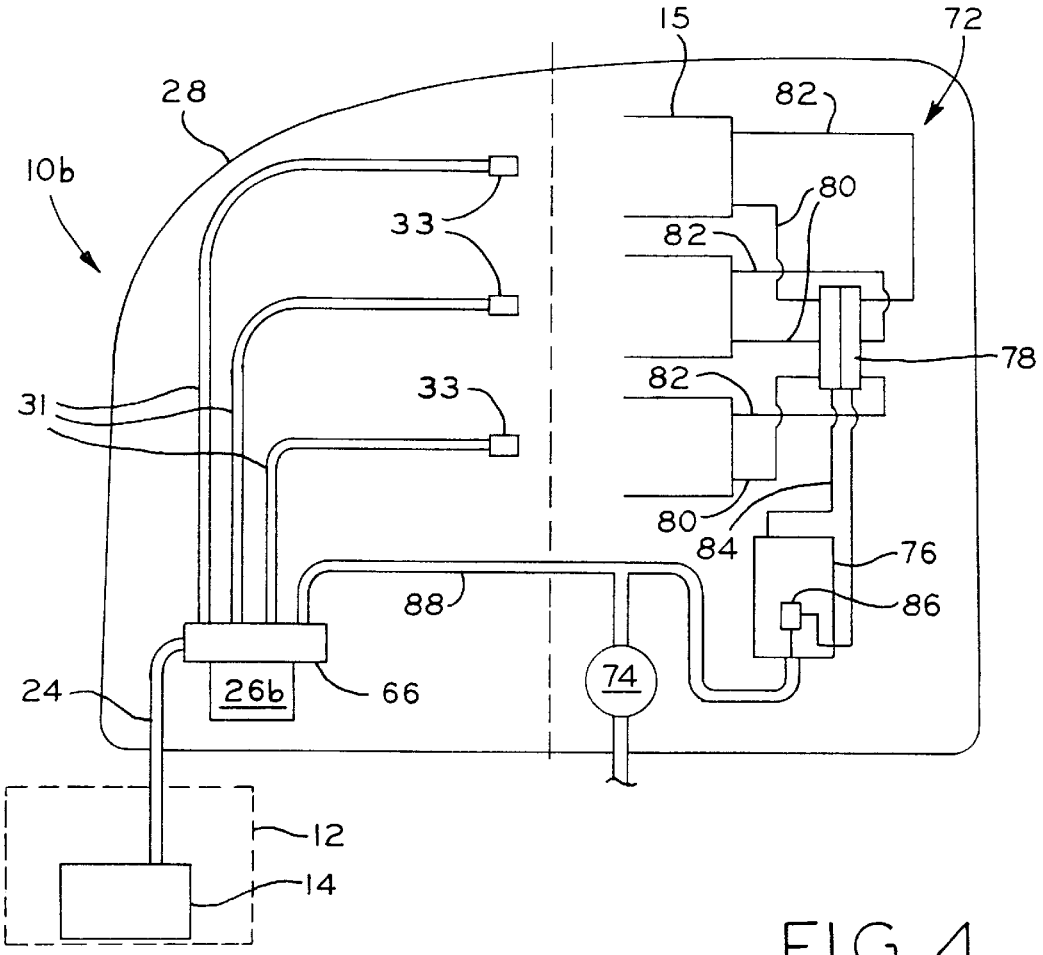
FIG. 4 is a partial schematic sectional view of the boat, engine, and oil injection system of FIG. 3.

Referring to FIG. 3, boat 11 includes outboard two-stroke engine 13 mounted thereon, including engine housing 28, outdrive 17, and prop 19. Oil injection system 10*b* includes oil reservoir 12 having oil pump 14 disposed therein. While illustrated in conjunction with a marine application, oil injection system 10*b* may be used with two-stroke engines in a variety of applications, such as in snowmobiles or lawn and garden implements, for example. As shown in FIG. 3, oil reservoir 12 is located externally of engine 13 and within boat 11, however, oil reservoir 12 may be located elsewhere, such as within engine 13. Additionally, three cylinders 15 in engine 13 are schematically illustrated in FIG. 4, however, engine 13 may include any number of cylinders 15.

Figure 1:
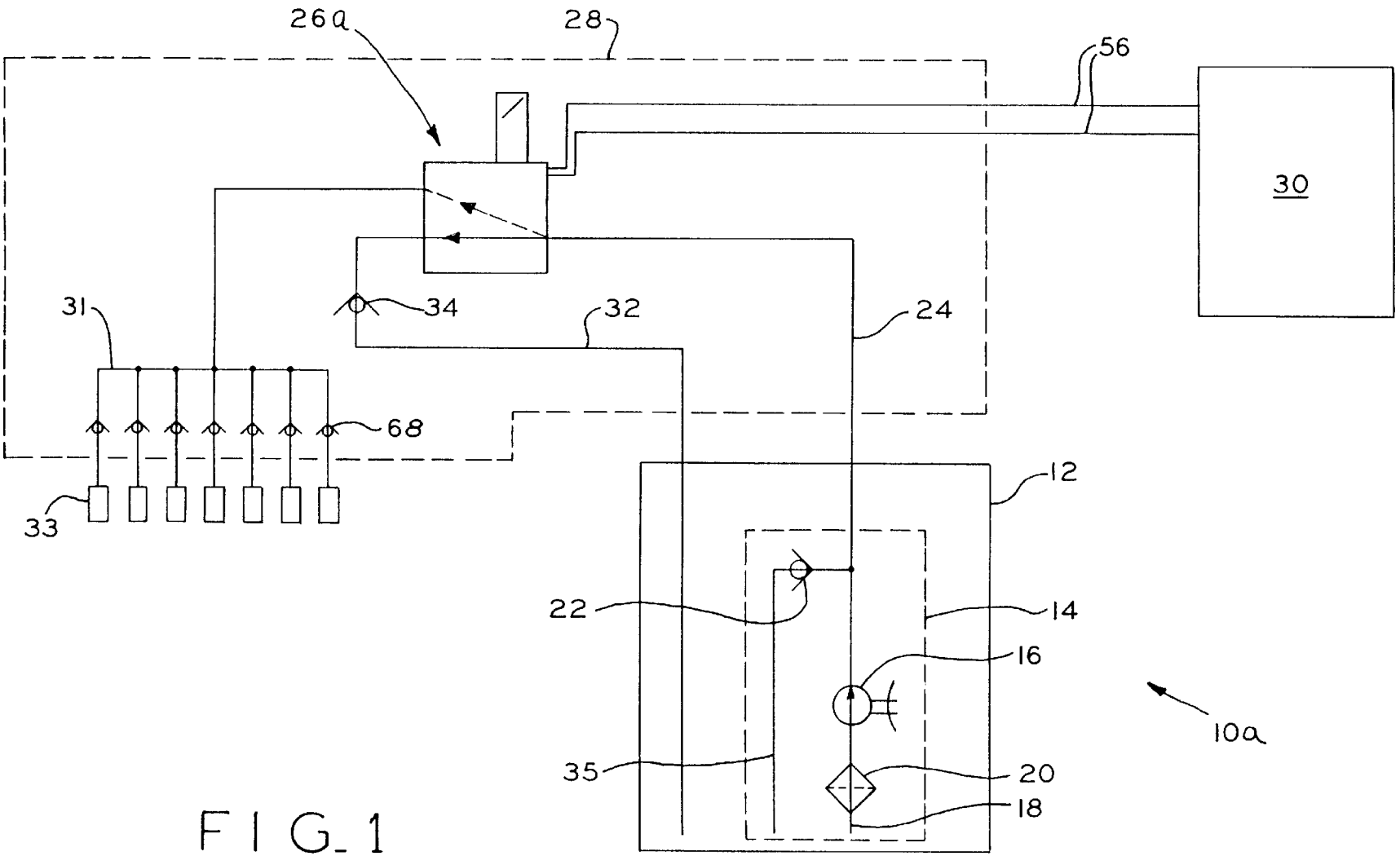
FIG. 1 is a schematic representation of an injection system, which includes a pressure regulator located externally of the oil reservoir, and an oil return line communicating oil from a solenoid valve to the oil reservoir through the pressure regulator.
Figure 5:
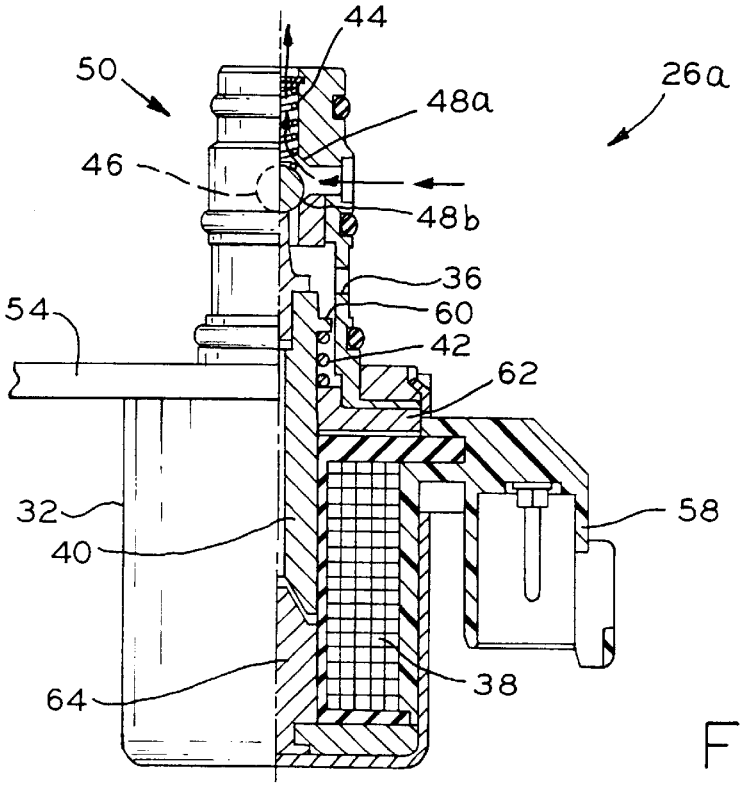
FIG. 5 is a partial sectional view of the solenoid valve of the oil injection-system of FIG. 1, shown in the energized position such that oil passes therethrough to the engine.
Figure 6:
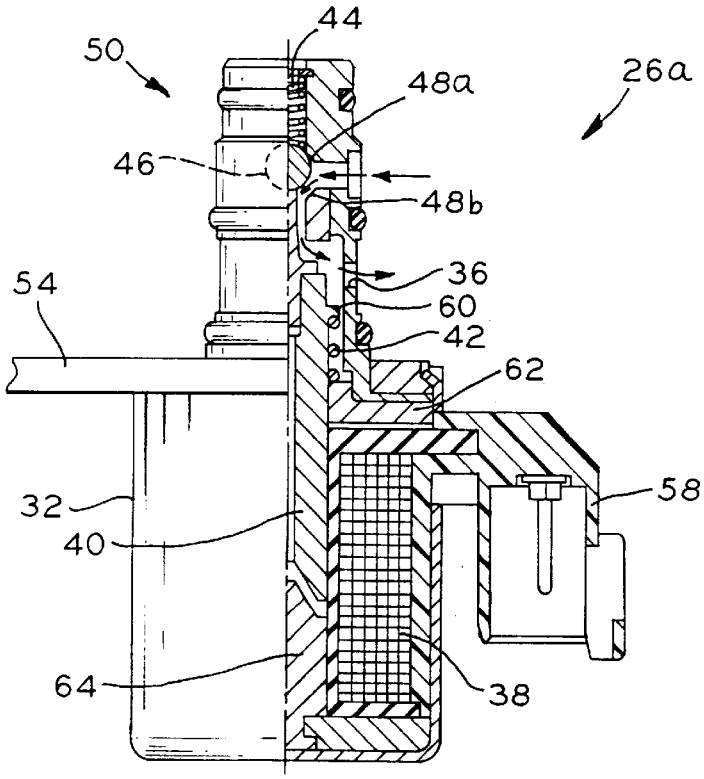
FIG. 6 is a partial sectional view of the solenoid valve of FIG. 5, shown in the de-energized position such that oil passes therethrough to return to the oil reservoir.

Referring now to FIGS. 1, 5, and 6, an oil injection system 10*a* includes oil reservoir 12 having oil pump 14 disposed therein. Oil pump 14 includes pump mechanism 16, pump inlet 18 and filter 20. High pressure relief valve 22 is incorporated into pump 14, and is operable to prevent damage to the pump structure due to over pressurization. As illustrated, valve 22 returns oil through high-pressure oil return line 35 to oil reservoir 12 when pressure in oil pump 14 exceeds a relatively high predetermined pressure.

Oil line 24 connects oil reservoir 12 to solenoid valve 26*a* located with housing 28 of a two-stroke engine (not shown). When solenoid valve 26*a* is energized by electronic control unit 30, oil may flow through solenoid valve 26*a* and thereafter through a plurality of distribution lines 31 to a plurality of oil injectors 33 for injecting oil into corresponding cylinders (not shown) of the engine. When solenoid valve 26*a* is not energized by electronic control unit 30, oil flows through oil return line 32 and pressure regulator 34 back into oil reservoir 12. Pressure regulator 34 functions to maintain pressure in oil line 24 and operates at a lower threshold pressure than high-pressure relief valve 22 of pump 14.

While oil injection system 10*a* provides improved metering by utilizing a plurality of oil injectors corresponding in number to the engine cylinders, there remain problems associated with oil injection system 10*a*. First, as shown in FIGS. 5 and 6, an oil return outlet 36 is required on solenoid valve 26*a* for communicating oil through oil return line 32 (FIG. 1), which necessitates a relatively costly and complex solenoid structure. Referring to FIG. 5, when coil 38 of solenoid valve 26 is energized, armature 40 is moved downward against the bias of solenoid spring 42, and, consequently, valve spring 44 actuates ball 46 from engagement with valve seat 48*a* and into engagement with valve seat 48*b* to allow oil to flow through valve mechanism 50 of solenoid valve 26*a*, as illustrated in FIG. 5. Upon energization of coil 38, valve spring 44 sometimes fails to immediately bias ball 46 securely onto valve seat 48*b*, resulting in a delay of oil flow to oil injectors 33 (FIG. 1). Since valve spring 44 must force ball 46 to travel through the thick and viscous oil flowing through solenoid valve 26*a*, seating of ball 46 onto valve seat 48*b* is relatively slow to occur. This delay allows oil flow behind ball 46 and through oil return outlet 36, thus restricting the flow of oil to oil injectors 33. This problem is exacerbated at engine start-up, when the oil is cold and highly viscous. A relatively large valve spring may facilitate seating of ball 46 onto valve seat 48*b*, however, such a large valve spring would undesirably add cost, complexity, and size to solenoid valve 26*a*. Oil injection system 10*a* further includes oil return line 32, as well as the fittings needed to connect oil return line 32 to solenoid valve 26*a* and oil reservoir 12. These additional components complicate the oil injection system and increase the cost and difficulty of assembly thereof. Furthermore, a leak in return line 32 or failure of pressure regulator 34 may result in an undesirable oil leak external of oil reservoir 12.

Figure 2:
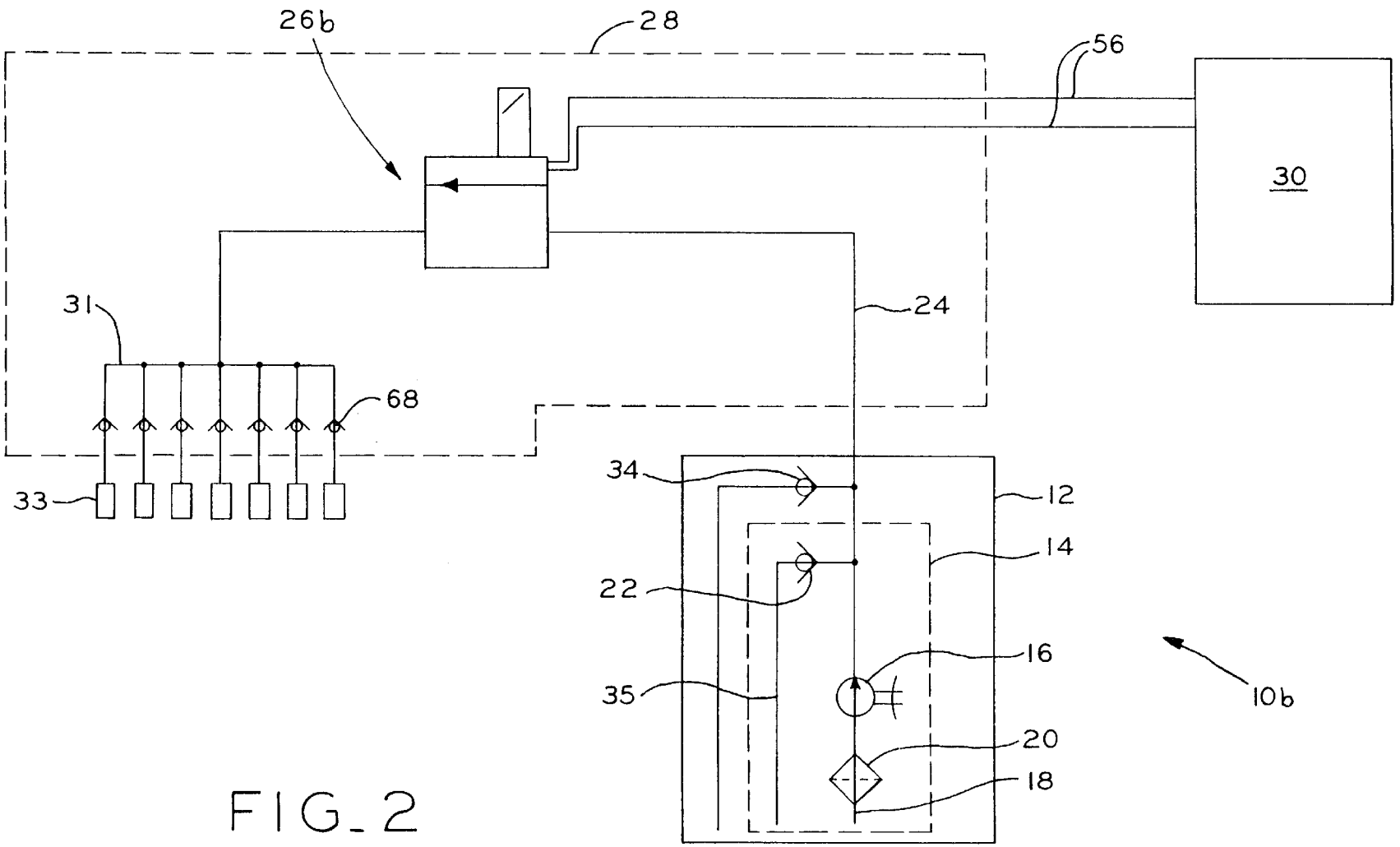
FIG. 2 is a schematic representation of an oil injection system in accordance with the present invention, including a pressure regulator located within the oil reservoir and a solenoid valve located in the oil line intermediate the oil reservoir and the oil injectors.

Referring now to FIGS. 2 and 4, oil injection system 10*b* includes oil reservoir 12 having oil pump 14 disposed therein. Oil pump 14 may be an electric or mechanical generator or rotary vane pump, or any other suitable type of pump. Oil pump 14 includes pump mechanism 16, pump inlet 18 communicating with oil reservoir 12, and filter 20 disposed adjacent pump inlet 18. Oil pump 14 also includes internal high pressure relief valve 22, which functions, in part, as a backup to pressure regulator 34 described below. High pressure relief valve 22 returns oil directly back into oil reservoir 12 through high pressure return line 35 when pressure within oil pump 14 exceeds a threshold level above which damage to oil pump 14 may result. Oil pump line 24 extends from oil pump 14 internally of oil reservoir 12, and also extends externally of oil reservoir 12 to communicate pumped oil from oil reservoir 12 to solenoid valve 26*b* located within engine housing 28.

Also included within oil reservoir 12 is pressure regulator 34. As oil pump 14 typically supplies more pumped oil than is necessary for injection into engine cylinders 15, pressure regulator 34 aids in metering the flow of pumped oil from oil pump 14 through oil pump line 24 to solenoid valve 26*b*, returning oil as necessary through oil return line 35 directly back into oil reservoir 12. Oil return line 35 is located within oil reservoir 12, and may optionally be omitted from pressure regulator 34.

Figure 7:
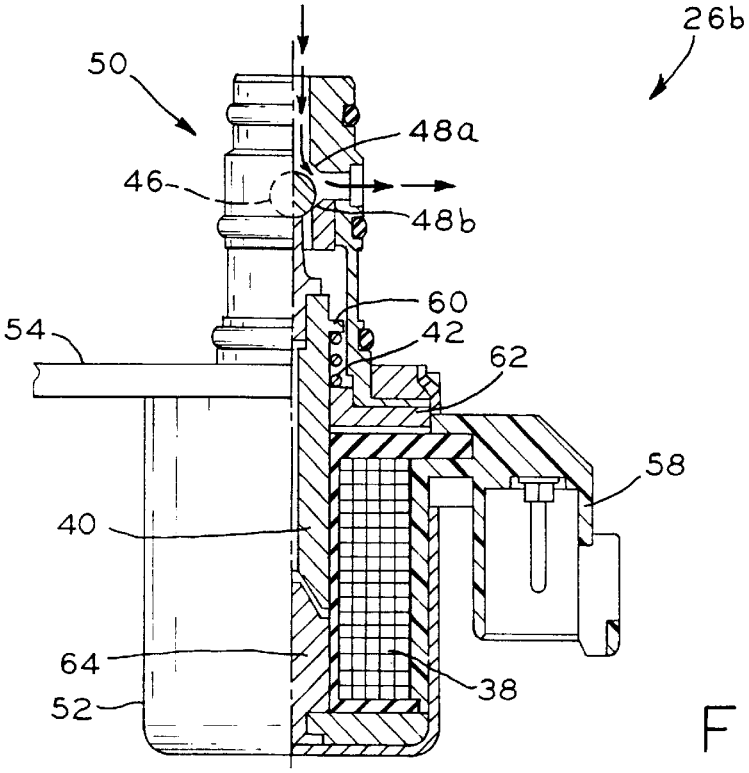
FIG. 7 partial sectional view of the solenoid valve of the oil injection system of FIG. 2, shown in the energized position such that oil passes therethrough to the engine.
Figure 8:
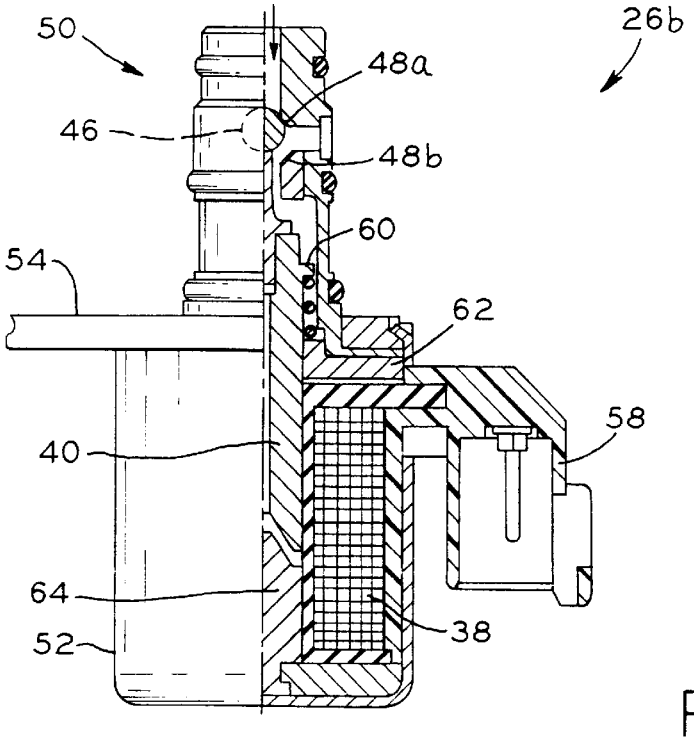
FIG. 8 is a partial sectional view of the solenoid valve of FIG. 7, shown in the de-energized position such that the flow of oil therethrough is blocked.

Solenoid valve 26*b* is shown in detail in FIGS. 7 and 8, and includes casing 52 having mounting flange 54 and electrical connector 58, to which is attached a pair of leads 56 (FIG. 2) connecting solenoid 26*b* to electronic control unit 30 (FIG. 2). Coil 38 is disposed within casing 52, and surrounds armature 40. Solenoid spring 42 is disposed between armature flange 60 and flex plate 62, and biases armature 40 upwardly away from pull piece 64. Valve mechanism 50 is disposed in casing 52, and includes a valve member, shown in FIGS. 7 and 8 as ball 46, moveable between valve seats 48*a* and 48*b*.

When coil 38 is energized by electronic control unit 30, as shown in FIG. 7, armature 40 is translated downward toward pull piece 64, and pressure applied by the flow of pumped oil moves ball 46 from valve seat 48*a* onto valve seat 48*b* to allow oil to flow through valve mechanism 50 to oil injectors 33 (FIG. 2). In this fashion, the oil flow itself, regardless of the viscosity of the oil, immediately moves ball 46 from valve seat 48*a* onto valve seat 48*b* upon energization of coil 38, thereby obviating the need for a valve spring within valve mechanism 50 for actuating ball 46. Additionally, the elimination of a valve spring within valve mechanism 50 allows pumped oil to be supplied through solenoid valve 26*b* at a higher pressure, resulting in a stronger and more accurate oil injection into cylinders 15 of engine 13 through oil injectors 33, and thereby improving engine lubrication.

When coil 38 is de-energized by electronic control unit 30, solenoid spring 42 biases armature 40 upwardly away from pull piece 64, and returns ball 46 from valve seat 48*b* to valve seat 48*a* to block the flow of oil through valve mechanism 50 of solenoid valve 26*b*. Selective energization of coil 38 of solenoid valve 26*b* by electronic control unit 30 meters the flow of oil through valve mechanism 50 of solenoid valve 26*b* to oil injectors 33. The metering of oil flow provided by both pressure regulator 34 and solenoid valve 26*b* allows for an accurate supply of adequately pressurized oil to oil injectors 33.

As shown in FIG. 4, when coil 38 of solenoid valve 26*b* is energized, pumped oil is allowed pass through solenoid valve 26*b* into manifold 66, from which a plurality of oil distribution lines 31 extend. Each oil distribution line 31 communicates oil to a respective oil injector 33 for injection into cylinders 15 of engine 13. Each oil distribution line 31 also includes a check valve 68 therein (FIG. 2). Check valves 68 prevent the flow of pumped oil into cylinders 15 when the oil is under insufficient pressure. When pumped oil is under sufficient pressure in oil distribution lines 31 to form tight injection streams, check valves 68 open to inject the oil streams into cylinders 15 through oil injectors 33. In this fashion, check valves 68 function to insure that oil is injected into cylinders 15 only in tight, controlled streams, preventing oil from undesirably "sputtering" or "dribbling" into cylinders 15.

Referring to FIGS. 2, 3, and 7–8, it may be seen that locating pressure regulator 34 within oil reservoir 12 advantageously eliminates the need for a return line connecting solenoid valve 26*b* with oil reservoir 12, thereby obviating the need for both a return outlet on solenoid valve 26*b* and a valve spring within valve mechanism 50 of solenoid valve 26*b*. This significantly simplifies the design and manufacture of solenoid valve 26*b* and-the overall design of oil injection system 10. Elimination of an oil return line between solenoid valve 26*b* and oil reservoir 12 additionally eliminates a potential source of oil leakage.

Fuel injection system 72, which may be used with oil injection system 10, is also schematically shown in the right side of FIG. 4. Fuel injection system 72 includes fuel pump 74, which pumps fuel from a fuel tank (not shown) to vapor separator/high pressure fuel pump 76. Vapor separator/high pressure fuel pump 76 pumps fuel to fuel block 78, which distributes fuel through a plurality of fuel outlets 80 to respective fuel injectors (not shown) for injection into cylinders 15. A plurality of injector return lines 82 return uninjected fuel from the fuel injectors to fuel block 78, and a fuel block return line 84 returns fuel from fuel block 78 to vapor separator/high pressure fuel pump 76. Fuel pressure regulator 86 is disposed within vapor separator/high pressure fuel pump 76 to meter fuel flow as necessary. Oil cleaner line 88 communicates an amount of oil from manifold 66 of oil injection system 10*b* to fuel injection system 72 to clean the fuel injectors of fuel injection system 72.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An oil injection system for a two-stroke engine, comprising:

an oil reservoir, said oil reservoir containing a volume of oil therein;

an oil pump disposed in said oil reservoir and operable to pump a measure of oil from said volume of oil through an oil line to the engine, said oil pump having a housing; and a pressure regulator disposed within said oil reservoir external of said pump housing and in fluid communication with said oil line downstream of said pump, said pressure regulator selectively returning a portion of pumped oil to said volume of oil.

2. The oil injection system of claim 1, wherein said pressure regulator includes a return line extending therefrom, said pressure regulator operable to return a portion of pumped oil from said oil line to said volume of oil through said return line.

3. The oil injection system of claim 1, wherein said oil pump includes a high pressure relief valve positioned in said pump housing, said high pressure relief valve operable to return oil from said oil pump directly back to said volume of oil, said high pressure relief valve having a high pressure relief valve pressure threshold, said pressure regulator having a pressure regulator pressure threshold, said high pressure relief valve pressure threshold being greater than said pressure regulator pressure threshold.

4. The oil injection system of claim 1, wherein said oil line extends externally of said oil pump and said oil reservoir, said oil line communicating pumped oil from said oil reservoir to a plurality of oil injectors.

5. The oil injection system of claim 4, further comprising a valve disposed in said oil line intermediate said oil reservoir and said oil injectors, said pressure regulator and said valve-together metering the flow of pumped oil to said oil injectors.

6. The oil injection system of claim 5, wherein said valve is operable between first and second positions, said valve blocking flow of pumped oil through said oil line in said first position and allowing flow of pumped oil through said oil line in said second position.

7. The oil injection system of claim 6, wherein said valve includes a valve member disposed therein, said valve member displaceable by the flow of pumped oil in said first position to allow oil-flow through said valve.

8. The oil injection system of claim 7, wherein said valve member comprises a ball moveable between a first valve seat and a second valve seat within said valve.

9. The oil injection system of claim 6, wherein said valve comprises a solenoid valve which is selectively energized and de-energized by an electronic control unit in said second and said first positions, respectively.

10. The oil injection system of claim 5, further comprising a manifold disposed intermediate said valve and said oil injectors, said manifold distributing pumped oil therefrom to said oil injectors through a plurality of oil distribution lines.

11. An oil injection system for a two-stroke engine, comprising:

an oil reservoir containing a volume of oil therein;

an oil line disposed within said oil reservoir and extending externally of said oil reservoir to communicate oil from said oil reservoir to a plurality of oil injectors;

an oil pump disposed in said oil reservoir and pumping oil from said volume of oil through said oil line;

a pressure regulator disposed in said oil reservoir, said pressure regulator in fluid communication with said oil line and operable to selectively return a portion of oil from said oil line to said volume of oil;

a valve disposed in said oil line intermediate said oil reservoir and said oil injectors, said valve operable between first and second positions whereby the flow of pumped oil through said valve is blocked in said first position and allowed in said second position.

12. The oil injection system of claim 11, wherein said pressure regulator includes a return line extending therefrom, said pressure regulator returning said portion of pumped oil from said oil line to said volume of oil through said return line.

13. The oil injection system of claim 11, wherein said oil pump includes a high pressure relief valve therein, said high pressure relief valve operable to return oil from said oil pump directly back to said volume of oil, said high pressure relief valve having a high pressure relief valve pressure threshold, said pressure regulator having a pressure regulator pressure threshold, said high pressure relief valve pressure threshold being greater than said pressure regulator pressure threshold.

14. The oil injection system of claim 11, wherein said valve comprises a solenoid valve which is respectively energized and de-energized by an electronic control unit.

15. The oil injection system of claim 11, wherein said valve includes a valve member disposed therein, said valve member displaceable by the flow of pumped oil in said second position to allow oil flow through said valve.

16. The oil injection system of claim 11, further comprising a manifold disposed intermediate said valve and said oil injectors, said manifold distributing pumped oil to said oil injectors through a plurality of oil distribution lines.

17. In an oil injection system for a two-stroke engine, the combination comprising:

an oil reservoir containing a volume of oil therein, said oil reservoir comprising:

an oil pump disposed within said oil reservoir and operable to pump oil from said volume of oil; and a pressure regulator disposed within said oil reservoir, said pressure regulator selectively returning a portion of oil from said oil pump to said volume of oil; and a valve disposed externally of said oil reservoir and in fluid communication with said oil reservoir, said valve selectively operable between a first position in which the flow of pumped oil through said valve is blocked and a second position in which the flow of pumped oil through said valve is allowed.

18. The combination of claim 17, additionally comprising an oil line respectively connecting said oil reservoir to said valve and said valve to a plurality of oil injectors, said pressure regulator and said valve together metering the flow of pumped oil to said oil injectors.

19. The combination of claim 17, further comprising a high pressure relief valve located within said oil pump, said high pressure relief valve operable to return oil from said oil pump directly back to said volume of oil, said high pressure relief valve having a high pressure relief valve pressure threshold, said pressure regulator having a pressure regulator pressure threshold, said high pressure relief valve pressure threshold being greater than said pressure regulator pressure threshold.

20. The combination of claim 17, wherein said valve comprises a solenoid valve which is selectively energized and de-energized by an electronic control unit in said first and said second positions, respectively, said solenoid valve further comprising a valve member disposed therein which is displaceable by the flow of pumped oil in said first position to allow oil flow through said solenoid valve.

* * * * *